US010234146B2

(12) United States Patent
Phillips et al.

(10) Patent No.: US 10,234,146 B2
(45) **Date of Patent: *Mar. 19, 2019**

(54) OVEN DOOR GLASS WITH INTERLOCKING MECHANISM

(71) Applicant: Electrolux Home Products, Inc., Charlotte, NC (US)

(72) Inventors: Bryan Thomas Phillips, Goodlettsville, TN (US); Brian Martin, Springfield, TN (US); Steven Baas, Hendersonville, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 120 days.

This patent is subject to a terminal disclaimer.

(21) Appl. No.: 15/591,388

(22) Filed: May 10, 2017

(65) Prior Publication Data

US 2017/0307227 A1 Oct. 26, 2017

Related U.S. Application Data

(63) Continuation of application No. 14/676,955, filed on Apr. 2, 2015, now Pat. No. 9,677,775.

(51) Int. Cl.
*F24C 15/34* (2006.01)
*F24C 7/08* (2006.01)
(Continued)

(52) U.S. Cl.
CPC ..... *F24C 15/34* (2013.01); *F24C 7/085* (2013.01); *F24C 15/028* (2013.01); *F24C 15/045* (2013.01)

(58) Field of Classification Search
CPC ..... F24C 15/04; F24C 15/34; F24C 15/028; F24C 7/085
(Continued)

(56) References Cited

U.S. PATENT DOCUMENTS 3,717,318 A 2/1973 Yamasita
3,991,738 A 11/1976 Krebs
(Continued)

FOREIGN PATENT DOCUMENTS

DE 10163150 7/2002
DE 102005004944 8/2006
EP 1081437 3/2001

OTHER PUBLICATIONS

International Search Report & Written Opinion issued in International Application No. PCT/US2016/025297 dated Aug. 10, 2016, 20 pages.

*Primary Examiner* — Gregory Huson
*Assistant Examiner* — Nikhil Mashruwala
(74) *Attorney, Agent, or Firm* — Pearne & Gordon LLP

(57) ABSTRACT

Provided is a door for a cooking appliance, such as an oven range, with multiple spaced apart glass panels. An interlocking mechanism promotes a proper installation of the glass panels, and interferes with the installation of the glass panels or with operation of the appliance if at least one of the panels is not properly installed. A switch with a plunger can be installed in the door, which allows the appliance to operate only when a failsafe electrical circuit is closed corresponding to a selected position of the plunger when the door is closed. The plunger is prevented from retaining that selected position if at least one of the glass panels is improperly installed or if a top cap is not properly seated or installed above the glass panels.

15 Claims, 6 Drawing Sheets

(51) Int. Cl.
*F24C 15/02* (2006.01)
*F24C 15/04* (2006.01)

(58) Field of Classification Search
USPC ..... 126/19 R, 200, 190, 194
See application file for complete search history.

(56) References Cited

U.S. PATENT DOCUMENTS

| | | | | |
|---|---|---|---|---|
| 4,401,930 | A | 8/1983 | Kato | |
| 4,638,788 | A | 1/1987 | Lacelot | |
| 5,447,145 | A * | 9/1995 | Cappello | F24C 15/04 126/194 |
| 5,546,927 | A | 8/1996 | Lancelot | |
| 7,014,281 | B2 | 3/2006 | Wuestefeld | |
| 8,091,543 | B2 | 1/2012 | Baumann et al. | |
| 2007/0199664 | A1 | 8/2007 | Zacher | |
| 2007/0204847 | A1 | 9/2007 | Lee et al. | |
| 2013/0019854 | A1 | 1/2013 | Lim | |
| 2016/0195278 | A1 | 7/2016 | Ivanovic | |
| 2016/0348414 | A1 * | 12/2016 | Ivanovic | H05B 6/6414 |

* cited by examiner

OVEN DOOR GLASS WITH INTERLOCKING MECHANISM

CROSS-REFERENCE TO RELATED APPLICATIONS

This application is a continuation of U.S. application Ser. No. 14/676,955, filed on Apr. 2, 2015, which is incorporated herein by reference.

BACKGROUND

1. Field of the Invention

The following description relates generally to an oven door and, more specifically, to an oven door with an interlock system that ensures proper assembly of glass panels in the oven door to permit operation of the oven range.

2. Description of Related Art

Conventional oven doors traditionally include a transparent glass door allowing the user to view the inside of the oven cavity while preparing food. Oven glass doors usually have more than one glass panel, for example to provide an insulating pocket of air between adjacent panels while still presenting a transparent view of the interior of the oven cavity from the outside. During the life of the oven range, it may be desirable to clean the glass panels to provide an unobstructed view into the oven cavity.

SUMMARY

The following presents a simplified summary of the invention in order to provide a basic understanding of some example aspects of the invention. This summary is not an extensive overview of the invention. Moreover, this summary is not intended to identify critical elements of the invention or to delineate the scope of the invention. The sole purpose of the summary is to present some concepts in a simplified form as a prelude to the more detailed description that is presented later.

According to one general aspect, a door for a cooking appliance may be provided. The door has a rear surface adapted to close a cooking cavity of the cooking appliance and a front surface opposite the rear surface. The door also has a removable top cap for providing access to install or remove the plurality of glass panels in or from the door and an interlocking mechanism effective to promote a proper installation of the plurality of glass panels.

In another general aspect, the interlocking mechanism comprises at least one bracket disposed adjacent a bottom portion of the door. The bracket is translatable along a translation path extending in a direction between the front and rear surfaces. The bracket is biased either forward or rearward along said translation path by a biasing force such that in its fully biased position a first cammed portion of the bracket is aligned with an insertion path of a first glass panel within the door. The first cammed portion is at an angle relative to the translation path such that on insertion of the panel a leading edge thereof will exert a downward force on the first cammed portion that urges the bracket along the translation path against the biasing force.

In another general aspect, the first cammed portion is substantially linear when viewed from the side.

In another general aspect, the translation path is a horizontal path.

In another general aspect, the bracket further comprises a second cammed portion spaced from the first cammed portion by a first substantially horizontal portion, and a second substantially horizontal portion adjacent the second cammed portion opposite the first horizontal portion.

In another general aspect, the first substantially horizontal portion being dimensioned such that in the fully-biased position of the bracket the first substantially horizontal portion of the bracket is aligned with an insertion path of a second glass panel within the door.

In another general aspect, the insertion paths of the first and second glass panels are substantially parallel and spaced from one another.

In another general aspect, the first cammed portion and first substantially horizontal portion of the bracket are dimensioned such that full insertion of the first glass panel results in translation of the bracket to an intermediate position along the translation path such that the second cammed portion is brought into alignment with the insertion path of the second glass panel.

In another general aspect, the second substantially horizontal surface is at least partially in an insertion path of a third glass panel within the door in the intermediate position of the bracket.

In another general aspect, the second cammed portion and second substantially horizontal portion of the bracket are dimensioned such that full insertion of the second glass panel after the first glass panel has been fully inserted results in translation of the bracket to a final position along the translation path such that a second substantially horizontal portion is withdrawn from the insertion path of the third glass panel.

In another general aspect, the interlocking mechanism comprises at least one bracket disposed adjacent a bottom portion of the door. The bracket is translatable along a translation path extending in a direction between the front and rear surfaces. The bracket is biased either forward or rearward along the translation path by a biasing force. The bracket comprises a first and second cammed portions separated from one another by a first substantially horizontal portion.

In another general aspect, the bracket further comprises a second substantially horizontal portion adjacent the second cammed portion opposite the first substantially horizontal portion.

In another general aspect, the bracket is configured such that insertion of a first glass panel along a first insertion path within the door will cause translation of the bracket to an intermediate position along the translation path via exertion of a downward force against the first cammed portion, and such that subsequent insertion of a second glass panel along a second insertion path within the door will cause further translation of the bracket to a final position along the translation path via exertion of a downward force against the second cammed portion.

In another general aspect, the interlocking mechanism comprises a bar extending laterally along at least a partial width of the door and disposed adjacent a bottom portion thereof. The bar is translatable along a translation path extending in a direction perpendicular to the bar's length between the front and rear surfaces. The bar is biased either forward or rearward along the translation path by a biasing force. The bar comprises a first and second cammed surfaces separated from one another by a first substantially horizontal surface.

In another general aspect, the bar further comprises a second substantially horizontal surface adjacent the second cammed surface opposite the first substantially horizontal surface.

In another general aspect, the bar is configured such that insertion of a first glass panel along a first insertion path within the door will cause translation of the bar to an intermediate position along the translation path via exertion of a downward force against the first cammed surface, and such that subsequent insertion of a second glass panel along a second insertion path within the door will cause further translation of the bar to a final position along the translation path via exertion of a downward force against the second cammed surface.

In another general aspect, the interlocking mechanism interferes with installation of at least one of the plurality of glass panels or with the installation of the top cap if at least one of the plurality of glass panels is not installed properly.

In another general aspect, each of the plurality of glass panels is slidably retained in the door from each side of the door by a pair of channel support members.

In another general aspect, the door further comprises a switch having a plunger that allows the cooking appliance to operate only when a failsafe electrical circuit is closed in a selected position of the plunger.

In another general aspect, either improper installation of at least one of the plurality of glass panels or a missing or improperly installed top cap prevents the plunger from retaining the selected position when the door is closed.

In another general aspect, a cooking appliance is provided. The cooking appliance comprises a cooking cavity enclosed by housing and a door for closing the housing. The door has a rear surface adapted to close a cooking cavity of the cooking appliance and a front surface opposite the rear surface. The door also has a removable top cap for providing access to install or remove the plurality of glass panels in or from the door and an interlocking mechanism effective to promote a proper installation of the plurality of glass panels.

In another general aspect, a method of controlling the operation of a cooking appliance having a door with a plurality of glass panels installed therein is provided. The method comprises the step of configuring an interlocking mechanism to interfere with installation of at least one of the plurality of glass panels in the door or with the installation of a top cap thereof if at least one of the plurality of glass panels is not installed properly.

In another general aspect, the method of controlling the operation of a cooking appliance having a door with a plurality of glass panels installed therein further comprises the step of configuring a switch with a plunger to block the operation of the cooking appliance in the absence of a closed failsafe electrical circuit corresponding to the plunger being in a selected position when the door is closed, wherein improper installation of at least one of the glass panels or of the top cap prevents the plunger from retaining the selected position when the door is closed. Other features and aspects may be apparent from the following detailed description, the drawings, and the claims.

BRIEF DESCRIPTION OF THE DRAWINGS

The foregoing and other aspects of the subject application will become apparent to those skilled in the art to which the subject application relates upon reading the following description with reference to the accompanying drawings.

DETAILED DESCRIPTION

Figure 1:
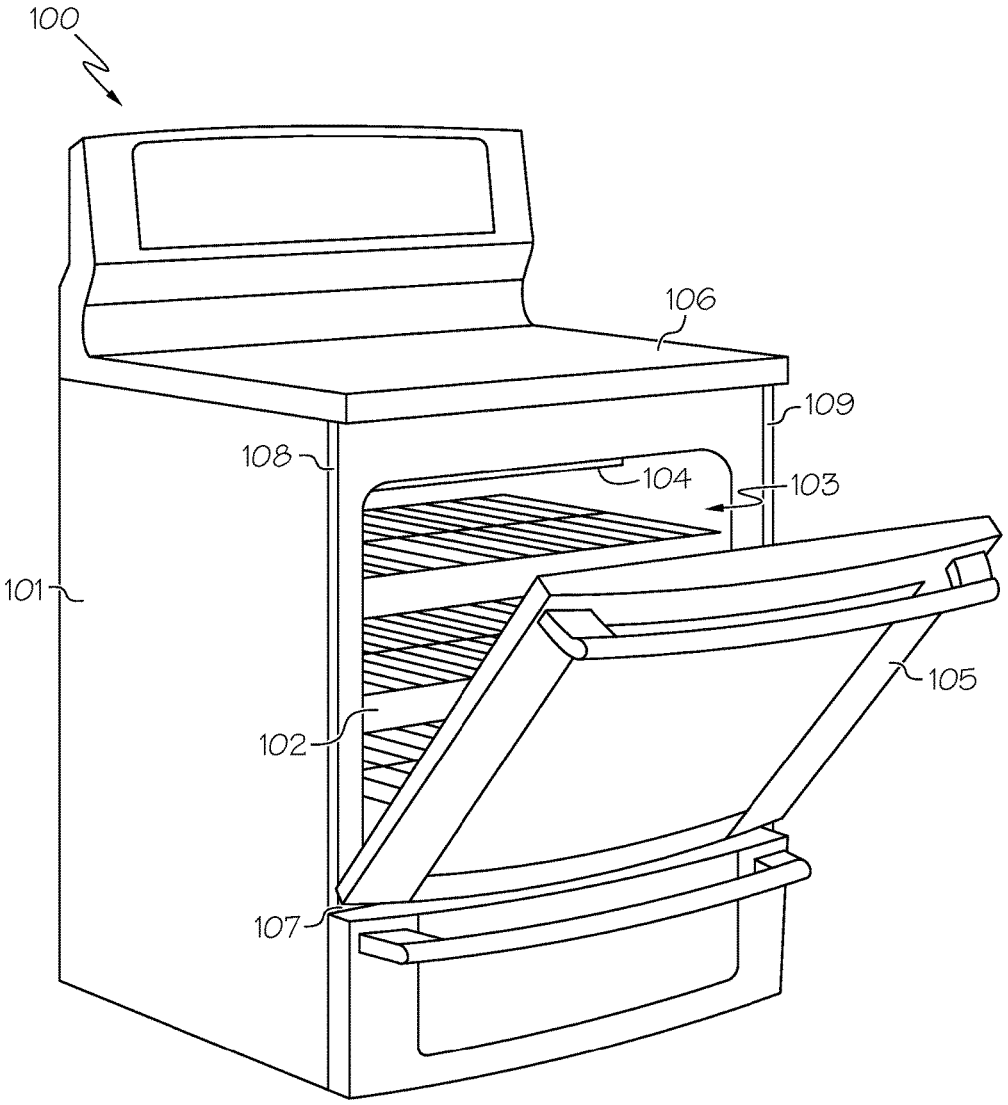
FIG. 1 is a perspective view of an oven range according to an embodiment.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein. Moreover, certain terminology is used herein for convenience only and is not to be taken as a limitation on the present invention.

It is also to be noted that the phrase "at least one of", if used herein, followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

One method of cleaning the glass panels assembled as parts of an oven door is to disassemble the oven door, remove the glass panels, clean the glass, and then reassemble the oven door again. Rather than requiring a professional service technician to disassemble the glass panels, clean them, and reassemble the door, it would be more convenient for the users if they are able to clean the glass panels themselves when needed. However, the door should include a guide to ensure proper reassembly of the glass panels.

Thus, there is a need for apparatuses and methods ensuring that the oven will only operate if the removable glass panels have been assembled in the oven door properly.

FIG. 1 shows an illustrative embodiment of a cooking appliance, such as an oven range 100. The oven range 100 can be built-in, wall-mounted or freestanding, although other configurations could also be used. The oven range 100 includes at least a housing 101, a cooking cavity 102 enclosed by the housing 101 with front opening 103, a heating element 104, and a door 105 for closing the housing 101.

The embodiment of the cooking appliance in FIG. 1 includes both an oven range 100 and cooktop heating elements 106. However, alternate embodiments of the cooking appliance can include only an oven range 100, without the cooktop heating elements 106, and can be used in a variety of different configurations such as built-in gas ovens, etc. In addition, the oven range 100 may include more than one cooking cavity 102. For example, the oven range 100 may include two oven cavities 102 (a "double-cavity" configuration). A double-cavity configuration may be used in a built-in wall oven range, freestanding range, or other configurations. However, configurations are not limited thereto and more than two oven cavities 102 may be included in other embodiments. For the sake of brevity, however, the embodiment of the cooking appliance shown in FIG. 1 will be used as an example to describe the oven door 105 below.

As shown on FIG. 1, the oven door 105 is used to close the front of the cooking cavity 102 from an outside area external to the oven range 100. The oven door 105 is pivotally mounted to the housing 101, e.g., to a lower frame 107 of the cooking cavity 102. The door 105 can be pivoted around a horizontal pivot point (not shown on FIG. 1) between a horizontal position in which the front opening 103 is open for access by the user of the appliance, and a vertical position in which the front opening 103 is closed by the door 105. Alternatively, the oven door 105 may be mounted to the left side frame 108 or the right side frame 109 of the cooking cavity 102. In this configuration, the oven door 105 can be tilted around a vertical pivot point adjacent to a side section of the cooking cavity 102.

Figure 2:
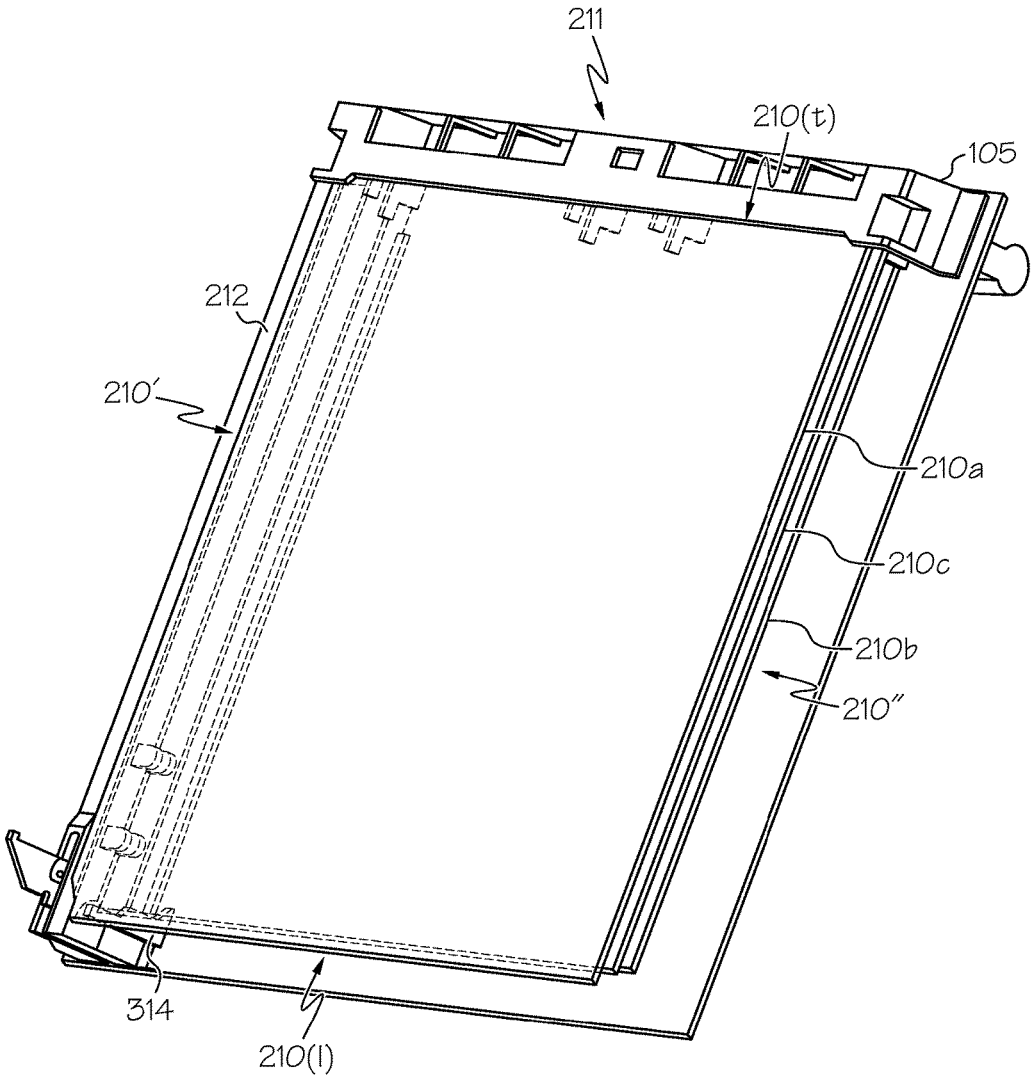
FIG. 2 is a rear perspective view of an illustrative embodiment of an oven door having a top cap, with portions of the door not shown in order to make the glass panels clearly visible.

FIG. 2 shows a rear perspective view of a "full-glass" oven door 105 with multiple glass panels (210*a*, 210*b*, 210*c*) and a top cap 211, according to a first example embodiment. However, embodiments are not limited thereto and other configurations are possible. For example, the innermost surface of the oven door 105 facing the oven cavity 102 may include an enameled steel door liner surrounding the glass panels (210*a*, 210*b*, 210*c*).

Turning back to FIG. 2, the glass panels (210*a*, 210*b*, 210*c*) are generally made of a special heat-resistant material, such as borosilicate glass, tempered soda-lime glass, or glass-ceramic, although other heat-resistant material could also be used. In the first example embodiment, the glass panels (210*a*, 210*b*, 210*c*) are each substantially rectangular in shape, each having two side-edge portions 210' and 210", an upper edge portion 210(*t*), and a lower edge portion 210(*l*). The glass panels (210*a*, 210*b*, 210*c*) are supported firmly in place relative to each other by means of a common peripheral support frame 212, which acts as the actual window casing or as a framework. Part of the peripheral support frame 212 is not shown in FIG. 2 in order to make the glass panels (210*a*, 210*b*, 210*c*) clearly visible.

Figure 3:
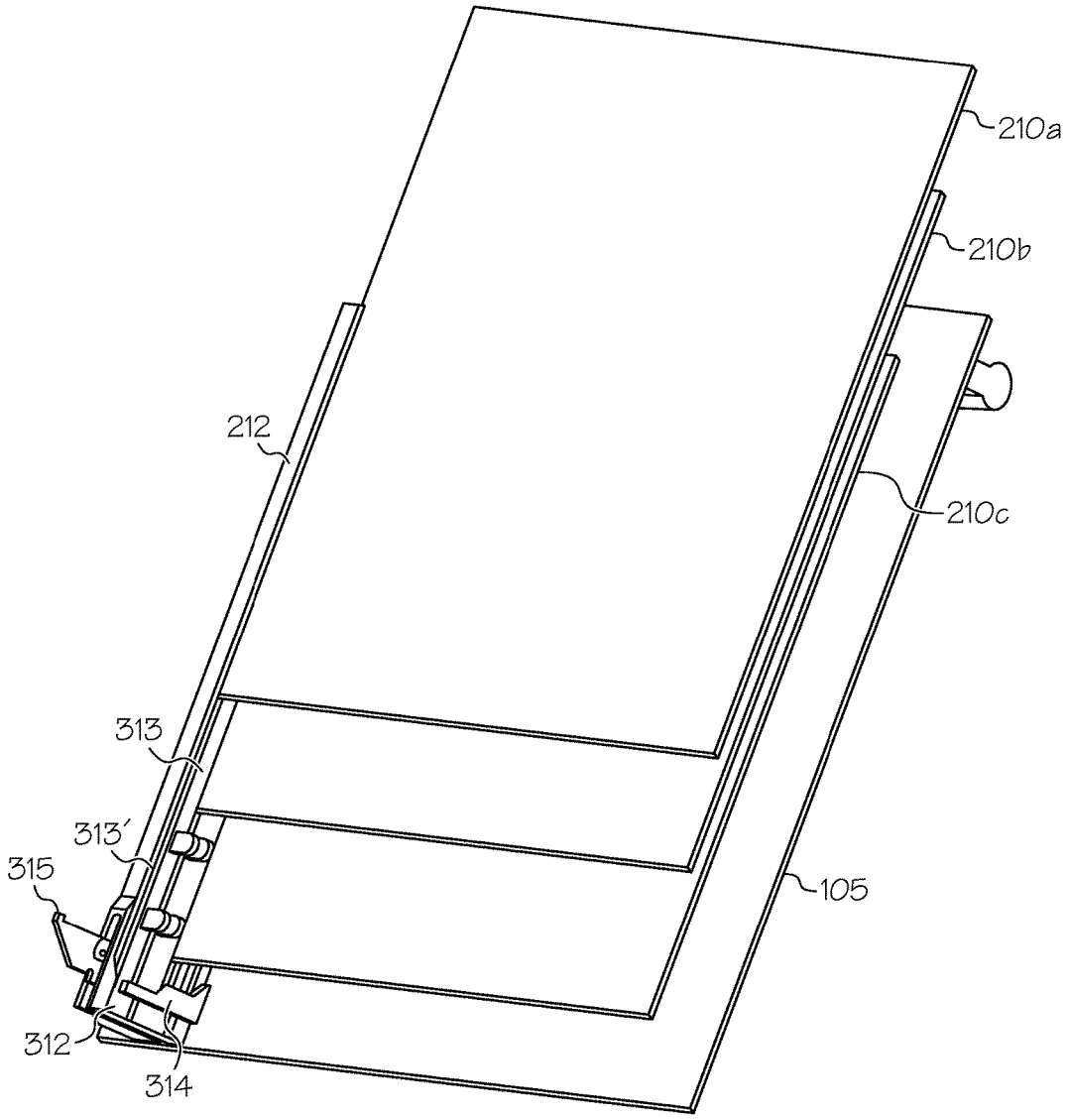
FIG. 3 is a rear perspective view of a further illustrative embodiment of an oven door with multiple glass panels, wherein some glass panels are partially inserted.

As further illustrated in FIG. 3, the glass panels (210*a*, 210*b*, 210*c*) are retained on both laterally spaced apart sides of the door support frame 212 by two laterally opposed channel members 313 (the right channel member is removed in FIG. 3) having respective support channels 313' each corresponding to and configured to slidingly accommodate the adjacent side edge portion of a respectively aligned one of the glass panels (210*a*, 210*b*, 210*c*) upon installation in the door 105. The support channels in the appropriate channel members 313 ensure that the glass panels (210*a*, 210*b*, 210*c*) are installed in a parallel arrangement relative to each other and are spaced apart from each other at a predetermined distance to provide an intermediate chamber between adjacent glass panels (210*a*, 210*b*, 210*c*) and the support frame 212. The size or volume of the intermediate chamber between adjacent glass panels (210*a*, 210*b*, 210*c*) and the support frame 212 depends on the spacing of the glass panels (210*a*, 210*b*, 210*c*). Depending on the number of glass panels, several intermediate chambers between adjacent glass panels (210*a*, 210*b*, 210*c*) may be provided. The intermediate chambers thermally insulate the cooking cavity 102 from the outside environment, so that the outer surface of the oven door 105 remains cool enough to touch.

Turning briefly back to FIG. 2, once fully seated in positions as part of the door assembly, the glass panels (210*a*, 210*b*, 210*c*) are retained at the top of the oven door 105 by a top cap 211. The top cap 211 can be made removable through the release of a snap, a push tab, or by other similar devices, thereby giving users the ability to access and remove the glass panels (210*a*, 210*b*, 210*c*) by sliding each glass panel (210*a*, 210*b*, 210*c*) through the associated and opposing support channel 313' as discussed above until the glass panel (210*a*, 210*b*, 210*c*) is freed from the top of the oven door 105. Such configuration provides the oven range operator with easy access to each of the glass panels (210*a*, 210*b*, 210*c*) for cleaning or replacement.

Returning to FIG. 3, an interlocking mechanism 314 may be provided in or adjacent to the bottom portion 312 of the common peripheral support frame 212 for the door 105 (only one side of the common peripheral support frame 212 is illustrated in FIG. 3), e.g., opposite the top cap 211. The interlocking mechanism 314 ensures that the glass panels (210*a*, 210*b*, 210*c*) are properly reassembled in the door 105 after being accessed and removed by the user, by interfering with proper seating of the panels and thereby with the installation of the top cap 211 unless all glass panels (210*a*, 210*b*, 210*c*) are installed in the common peripheral support frame 212 of the oven door 105 properly.

An embodiment of the interlocking mechanism to ensure the proper installation of glass panels in the door is shown in FIG. 3. In the illustrated embodiment, the interlocking mechanism includes a bracket 314 installed or disposed adjacent either the left side or the right side of the bottom portion 312 of the common peripheral support frame 212. The bracket 314 may be made of a special heat-resistant material, such as thermoplastic having a high softening point above that to which it may be exposed through operation of the oven range, although other heat-resistant materials could also be used.

The bracket 314 is substantially fixed against vertical translation toward or away from the bottom portion 312 of the door 105, but can translate along a horizontal path perpendicular to the vertical and which extends between the front and the rear of the oven door 105; i.e. toward and away from the face of the door 105 that seals the opening 103 of the cooking cavity 102 when closed. As further illustrated in FIGS. 4A-4D, the bracket 314 includes at least first and second cammed portions 415 and 414 at an upper part of the bracket 314. A first substantially horizontal portion 417 is disposed between the first and second cammed portions, and a second substantially horizontal portion 416 is disposed rearward of the second cammed portion 414 relative to the door 105, i.e., toward the oven cavity.

In the illustrated embodiment, the first cammed portion 415 is substantially linear (when viewed from the side) and is oriented at an angle relative to the first horizontal portion 417, such that as it proceeds downward toward the bottom portion 312 of the frame 212. The first cammed portion terminates at an intersection with the first horizontal portion 417. The second cammed portion 414 is located rearward of the first cammed portion 415, separated therefrom by the length of the first horizontal portion 417. The second cammed portion 414 is also oriented at an angle relative to the first horizontal portion 417, and extends downward therefrom until it reaches and intersects with the second substantially horizontal portion 416 as illustrated. In preferred embodiments, the first and second horizontal portions 417 and 416 are parallel to one another and substantially parallel to the horizon when the oven door 105 is installed on an oven range and closed.

The bracket 314 configured as above is biased in a rearward direction of the door 105. The bracket 314 can be spring biased, for example via a compression spring 410 mounted between a front face of the bracket and an inner wall of the outside portion 418 of the oven door 105. Alternatively, other conventional biasing mechanisms, such as differently configured springs (e.g. torsion springs, leave springs, etc.) can be used.

The dimensions of the bracket 314 are selected such that in its resting condition biased rearwardly toward the inner portion of the door 105, at least a portion of the first cammed portion 415 is aligned with the path to be followed by the outermost glass panel 210*b* upon insertion thereof into the door 105 from the top. As noted above, that path preferably is defined between opposed channels in the frame 212 that will accommodate sliding insertion of the glass panel 210*b*. In its resting (i.e. fully biased) condition, the bracket 314 is further dimensioned such that the second cammed portion 414 is disposed somewhat rearward (relative to the door 105) of the path to be followed by the intermediate glass panel 210*c* upon insertion thereof into the door 105 from the top. Thus, in the bracket's 314 resting condition biased rearwardly, the intermediate glass panel 210*c* would encounter the first horizontal portion 417 upon insertion into the door 105. Finally, in the resting condition of the bracket 314 biased rearwardly, the second horizontal portion 416 will be located sufficiently rearward so that it will be in the path of the innermost glass panel 210*a* upon insertion thereof into the door 105 from the top.

With reference now to FIGS. 4A-D, the operation of the interlocking mechanism configured as a bracket 314 as discussed above will be described. As noted above, the interlocking mechanism (e.g. bracket 314) ensures that glass panels are inserted into the oven door 105 and seated properly to accommodate installation of the top cap 211. Otherwise, operation of the oven door 105, and accordingly of the oven range, is inhibited or prevented. In the illustrated embodiment (FIGS. 4A-D) a proper sequence of insertion would be as follows: outermost panel 210*b*, intermediate panel 210*c*, and then innermost panel 210*a*.

Figure 4A:
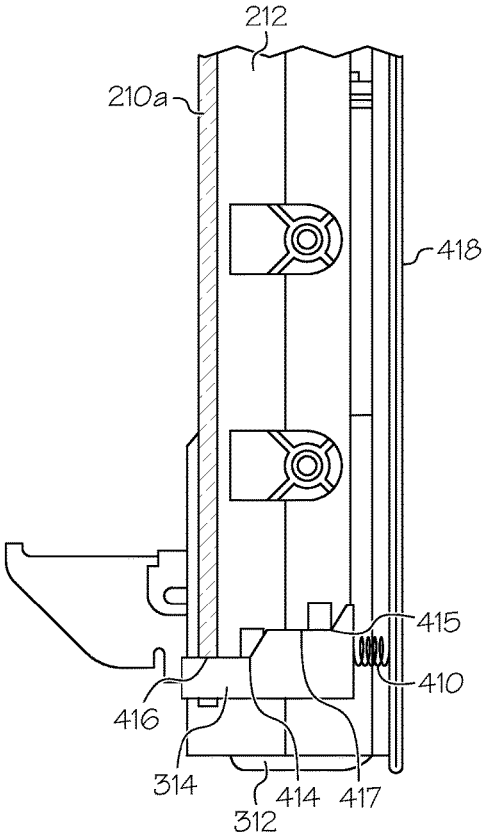
FIGS. 4A-4D illustrate several side views, partially broken away, of an embodiment of an oven door with a first interlocking mechanism, wherein installation of intermediate and innermost glass panels is inhibited unless all glass panels are installed properly.
Figure 4B:
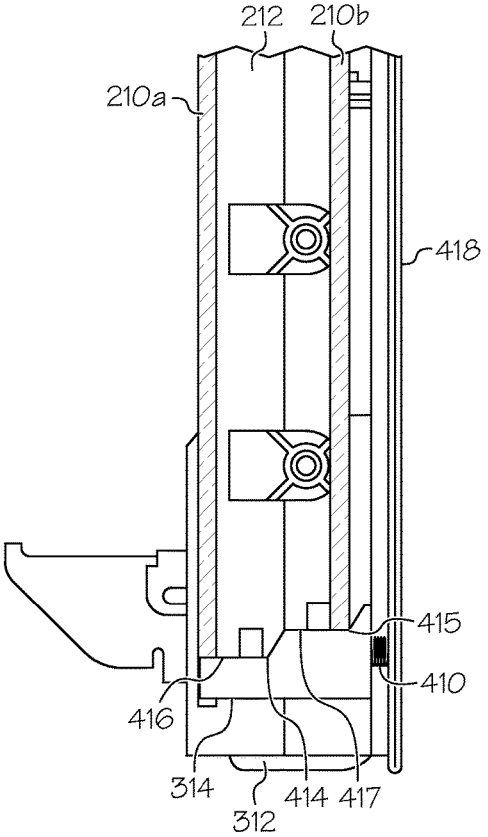
Figure 4C:
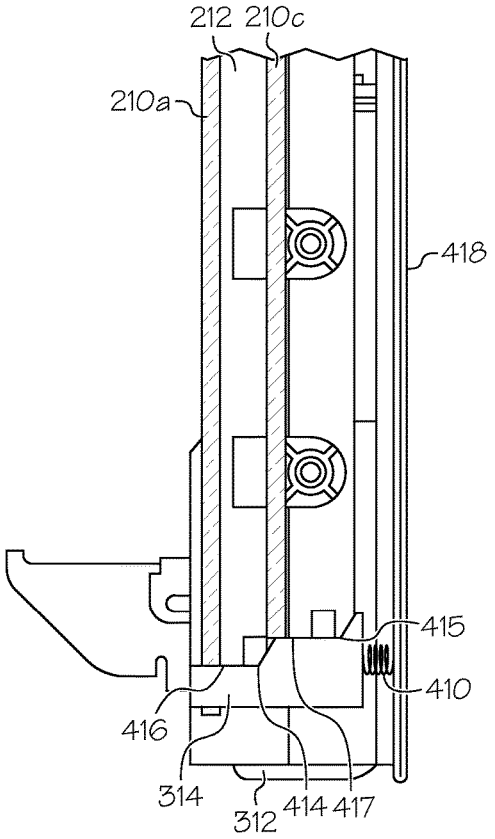

FIGS. 4A, 4B, 4C, and 4D show side cross-sectional views of a bottom portion of the oven door 105 wherein the glass panels (210*a*, 210*b*, 210*c*) have been installed in different sequences, as well as the corresponding orientation of the bracket 314 that would result from each sequence. In particular, the following insertions sequences are represented:

FIG. 4A: Innermost panel 210*a* first;

FIG. 4B: Outermost panel 210*b* first, then innermost panel 210*a*;

FIG. 4C: Intermediate panel 210*c* first, then innermost panel 210; and FIG. 4D: Outermost panel 21*b* first, then intermediate panel 210*c*, then innermost panel 210*a* (the proper sequence).

Figure 4D:
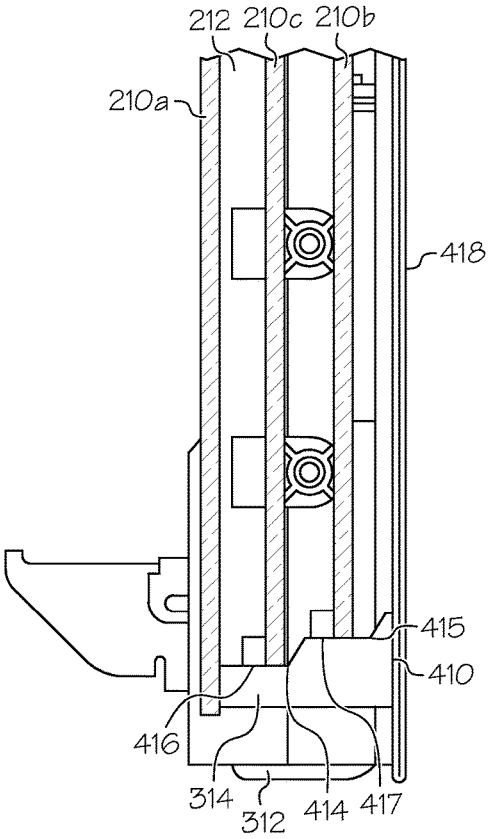

FIGS. 4A, 4B, and 4C illustrate the operation of the interlocking mechanism (as bracket 314) when the different glass panels (210*a*, 210*b*, and 210*c*) are assembled in different sequences. FIG. 4D shows the interlocking mechanism (bracket 314) in a locked position after the insertion and proper seating of all glass panels (210*a*, 210*b*, and 210*c*). In the preferred sequence, the outermost glass panel 210*b* is inserted first along a path toward the first cammed portion 415. Upon reaching the first cammed portion 415, the leading edge of the outermost panel 210*b* exerts a downward force on that portion that, as a result of its angle relative to the direction of the force, urges the bracket 314 in a frontward direction (relative to the door 105) against the biasing force of the compression spring 410. This frontward movement of the bracket 314 continues until the leading edge of the outermost panel 210*b* reaches and rests against the first horizontal portion 417 of the bracket 314. The length of that first horizontal portion 417 is such that once the bracket 314 has been frontwardly urged upon insertion of the outermost panel 210*b* the second cammed portion 414 becomes aligned with the insertion path of the intermediate panel 210*c*. At this point, upon insertion of the intermediate panel 210*c* its leading edge will encounter and exert a downward force against the second cammed portion 414 similarly as above described, thus similarly and further urging the bracket 314 frontward until it encounters and rests against the second horizontal portion 416. Finally, the length of the second horizontal portion 416 is selected such that upon being urged frontward via complete insertion of the intermediate panel 210*c* the second horizontal portion 416 is withdrawn from the insertion path of the innermost panel 210*a*, thus no longer presenting an impediment to its insertion and proper seating. As will be appreciated, failure to follow the preferred insertion sequence for the glass panels may result in one or several of them being improperly seated, such that closure or installation of the top cap 211 is inhibited or prevented.

FIG. 4D shows the bracket 314 in a locked position against the biasing action of the compression spring 410 after all glass panels (210*a*, 210*b*, and 210*c*) have been assembled properly. Conversely, FIGS. 4A-C illustrate the orientation and operation of the bracket 314 based on glass-panel installation in a variety of less preferred sequences. As illustrated in FIG. 4A, if the innermost glass panel 210*a* is inserted without first inserting the outermost glass panel 210*b* and next inserting the intermediate glass panel 210*c* in the illustrated embodiment, the bracket 314 will not be urged frontward toward the outside portion of the oven door 418, thus removing the second horizontal portion 416 from the path of the innermost panel 210*a*. As a result, it will be impossible to insert the innermost glass panel 210*a* all the way because its path is blocked by the second horizontal portion 416. Insertion of innermost glass panel 210*a* first as in this scenario will also interfere with the complete installation of at least the intermediate glass panel 210*c* (which now will encounter the first horizontal portion 417 in its path). As a result the top cap 211 also will not be able to be installed or properly seated since at least two of the glass panels (210*a* and 210*c*) would not be completely inserted and thus would inhibit installation of the top cap 211 over them. In desirable embodiments, the oven door 105 can be configured such that absent proper installation of the top cap 211 the oven range will not operate.

In FIG. 4B the outermost glass panel 210*b* was installed first, as is preferred. However, instead of next installing the intermediate glass panel 210*c*, the innermost panel 210*a* was installed. Because the intermediate panel 210*c* was not installed, the path of the innermost panel 210*a* is blocked by the second horizontal portion 416. It should be noted that in this sequence when utilizing the illustrated embodiment, subsequent insertion of the intermediate glass panel 210*c* may urge the bracket 314 forward upon engagement with the second cammed portion 414, resulting in withdrawal of the second horizontal portion 416 from the path of the innermost panel 210*a*. This is because insertion of the outermost panel 210*b* first will result in alignment of the second cammed portion 414 with the path of the intermediate glass panel

210*c*. Thus it may be possible to salvage this less-preferred insertion sequence without removing all panels and starting over. However, sudden withdrawal of the second horizontal portion 416 after the innermost panel 210*a* has been seated against it could result in that panel falling downward in the oven door. Accordingly, it may be desirable to include a damping element at the base of the travel path of the innermost panel 210*a* below the bracket 314, such as a resilient gasket (not shown) to dampen any impact with the innermost panel 210*a*.

In FIG. 4C, the innermost panel 210*a* was inserted first, followed by the intermediate panel 210*c*. Because the panels were not inserted in the preferred sequence each of them is seated against an improper surface thus inhibiting complete insertion and proper seating of the panels. It is again to be noted that this sequence might be salvaged by next inserting the outermost panel 210*b*, which will result in alignment of the second cammed portion 414 with the intermediate panel 210*c*, which in-turn may result in withdrawal of the second horizontal portion 416 frontward and out of the path of the innermost panel 210*a*, which may result in the latter falling along its insertion path further into the door 105. Again, for this reason it may be desirable to include a damping element to damp any resulting impact of the leading edge of the innermost panel 210*a* at the base of the door 105.

The interlocking mechanism in the illustrated embodiment (e.g. bracket 314) ensures that only when all of the glass panels (210*a*, 210*b*, 210*c*) are fully inserted and properly seated, the top cap 211 can be installed. In a preferred embodiment, only after the top cap 211 has been installed, the oven door 105 can close and the oven range can operate. Thus, the interlocking mechanism 314 discourages an incorrect assembly sequence of the glass panels (210*a*, 210*b*, 210*c*) while providing the user with the convenience of removing the glass panels (210*a*, 210*b*, 210*c*) when needed. In a preferred embodiment discussed below, it also cooperates with a switch that is actuable when the properly assembled (including installation and seating of all glass panels) to close a failsafe circuit that will allow the oven range to operate.

As noted above one preferred embodiment for the interlocking mechanism is a bracket 314 disposed adjacent either the left or right sides of the oven door 105 adjacent the base of the door. However, a plurality of such brackets can also be provided spaced apart from one another along the base. For example, a pair of such brackets 314 can be provided, one adjacent each of the left and right sides of the oven door. Additional such brackets 314 also can be provided, for example spaced equidistant from one another along a lateral direction. In a further embodiment, the interlocking mechanism 314 can be provided as a bar extending laterally along at least a partial width of the door, wherein the respective cammed and horizontal portions of the bracket 314 as described above instead constitute corresponding planar surfaces extending laterally. Regardless of the particular configuration, the vertical lengths (relative to the door 105) of each of the glass panels 210*a*, 210*b*, 210*c* are selected such that each of those panels will extend a proper vertical distance through the door when properly seated so as to not inhibit installation or closure of the top cap 211, or otherwise to interfere with operation of the oven range.

Moreover, the arrangement and order of horizontal and cammed portions or surfaces of a bracket or bar forming all or part of the interlocking mechanism 314 can be selected to promote a particular desired sequence of insertion of an appropriate number of glass panels in a specific oven door. For example, the illustrated embodiments show only three glass panels. But other numbers of panels could be incorporated, in which case a suitable bracket 314 having an appropriate number and sequence of cammed and horizontal portions/surfaces could be used to promote a proper installation. In addition, the biasing direction for the bracket(s) 314 (or bar as mentioned above) can also be forward toward the front portion of the oven door 105 instead of rearward, for example if the desired sequence of insertion were reversed from that described in the embodiment above.

Figure 5:
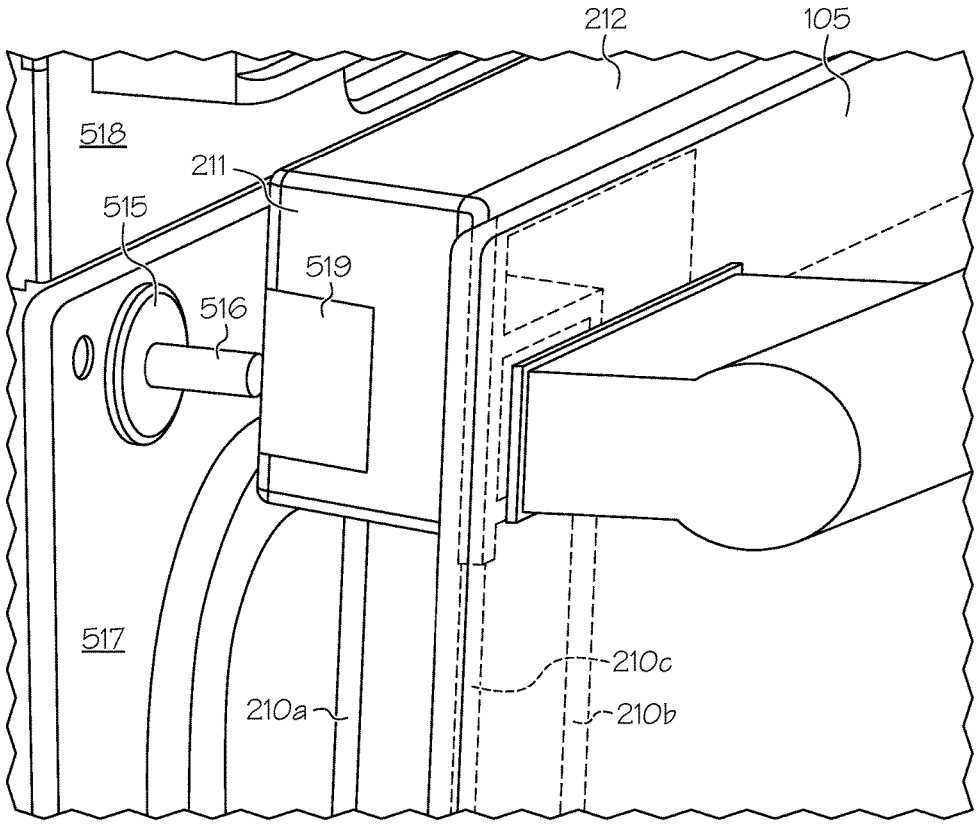
FIG. 5 is a partial perspective view of an oven door that has been hinged to an oven range, the range including a plunger switch adapted to inhibit oven operation if the oven door is not properly closed with glass panels properly installed.

FIG. 5 shows a close-up perspective view of the oven door 105 nearly closed on an associated oven range according to an embodiment. A door switch 515 with a plunger 516 is installed in the housing of the oven such that the plunger 516 extends forward in the direction of the oven door 105 when closed. The oven door 105 may be configured to press against the plunger 516 when the oven door 105 is closed and to release the plunger 516 when the oven door 105 is open while the plunger 516 communicates each respective position to a controller of the oven range through an electrical signal. The switch 515 may include, in addition to the plunger 516, a switch body and a plug portion (the switch body and the plug portion are not shown in FIG. 5), and may be mounted so that the switch body and the plug portion are substantially enclosed within the appliance and only the plunger 516 or a part of the plunger 516 is exposed when the door 105 is opened. The plug portion of the switch 515 may be operatively coupled to an electrical circuit of the appliance and may be in operative communication so that the circuit can detect the different positions of the plunger 516 relative to the oven door 105.

In the embodiment illustrated in FIG. 5, the switch 515 is secured to the front portion 517 of the oven frame 518 and is configured to communicate when the oven door 105 is in a closed and locked state to allow the oven range to operate. The plunger portion 516 extends forwardly beyond the front portion 517 of the oven frame 518 so that the oven door 105 can depress the plunger 516 when the oven door 105 is closed.

In one embodiment, the switch 515 may be coupled to a quick release locking mechanism that can automatically and quickly lock the oven door 105 in the closed position. This can include a standard solenoid device that holds a pin in place. Such a device will typically hold a pin or bolt in place until actuated. When actuated, the pin quickly moves into the locked position. Alternatively, the switch 515 can be coupled to any suitable device that is configured to be switchable between a locked position in which the oven door 105 is engaged in a closed or locked position (as communicated by the resulting position of the plunger 516) when the oven range is operated, and an unlocked position or state in which the movement of the oven door 105 is unimpeded by the locking device.

In a preferred embodiment, the plunger 516 can be aligned with a plunger receptacle 519 formed in the oven door 105 (for example formed as a window in the top cap 211 facing the oven housing) when the door is closed. In this embodiment, as the door 105 is closed against the housing the plunger 516 will be aligned and received within the receptacle 519 and will be depressed by the first object encountered in its path. Preferably, the oven door 105 is configured so that a portion of at least the innermost glass panel 210*a*, when installed, will be in the path of the plunger 516 extending into the receptacle 519, e.g. through the window in top cap 211. If the innermost glass panel 210*a* is present, the plunger 516 will be depressed a sufficient degree upon closing the door 105 to close a failsafe circuit or otherwise communicate with a controller that it is safe to operate the oven range. Accordingly, the interlocking mechanism (bracket 314) and switch 515 work together to ensure both that all glass panels are properly installed and seated before the oven can be operated. If only the innermost panel 210*a* is installed, it will stick out above the upper portion of the door 105 thus interfering with or preventing proper installation or closure of the top cap 211, thus misaligning the window therein with the plunger 516 and also optionally physically interfering with closure of the door 105. A misaligned or improperly closed top cap 211 also will be obvious to an observer as an indication that all glass panels have not been properly installed. Thus, only when all three (in the illustrated embodiment) glass panels have been properly installed and seated, can the top cap 211 be installed and the plunger 516 depressed sufficiently when the door 105 is closed to permit operation of the oven range.

The switch 515 may include two or more electrical prongs extending rearwardly from the plunger 516 to the oven appliance which may house various electric components in order to establish an electrical connection between the plunger 516 position and appropriate control circuitry. The switch 515 may also include a plurality of electrical contacts which may indicate the position of the plunger 516. For instance, the electrical contacts may signal whether the plunger 516 is fully depressed, indicating that the oven door 105 is closed.

In a further alternative the plunger 516 may be composed of or include an electrical conductor that completes a circuit with a receptive conductor located in the aforementioned receptacle 519, especially when the receptacle 519 is formed in or as part of the top cap 211, which will be properly aligned to contact the plunger 516 only if the top cap 211 is properly installed and aligned. In this manner, contact between the plunger 516 (or its conductor element) and the complementary element within the receptacle 519 may close an electrical failsafe circuit that tells a controller that the oven range is safe to operate. Because a closed electrical circuit is created between the plunger 516 and the top cap 211 or any suitable circuit components that may be installed in the top cap 211, in this embodiment such a circuit will allow the oven range to operate only when the top cap 211 is installed in a fully locked position. If all of the glass panels (210*a*, 210*b*, 210*c*) and the top cap 211 are installed properly, the switch 515 will be operated by the oven door 105 when the door is closed, thereby rendering the oven range operable. If some of the glass panels (210*a*, 210*b*, 210*c*) are not installed properly, this may result in the top cap 211 being misaligned, which would result in the plunger 516 failing to make contact with the complementary element in the receptacle 519. This will result in the failsafe circuit remaining open, thus preventing operation of the oven range.

In the embodiments described above with reference to FIG. 5, the switch 515 relies on the conduction of signals, or the interruption of electric signals (e.g., closed and or open circuits) to determine whether the oven door is correctly assembled and closed, thereby affecting the operability of the oven range. Yet other embodiments can utilize optical sensors and the like to determine whether the various components are correctly assembled as a requirement to render the oven range operable.

Each of the oven door embodiments described above have various advantages for use in particular situations. Further flexibility can be provided by combining different features of the various embodiments into a single oven door, or by using either the first or the second interlocking mechanisms depending on the circumstances in different situations. For example, the oven door may have one type of interlocking mechanism for some situations, but another type of interlocking mechanism for another situation. Furthermore, in some embodiments, an oven door may have both a mechanical interlocking mechanism and an electrical interlocking mechanism, proving additional controls, for example.

Illustrative embodiments have been described, hereinabove. It will be apparent to those skilled in the art that the above apparatuses and methods may incorporate changes and modifications without departing from the general scope of this disclosure. The disclosure is intended to include all such modifications and alterations disclosed herein or ascertainable herefrom by persons of ordinary skill in the art without undue experimentation.

What is claimed is:

1. A door for a cooking appliance configured to receive a plurality of glass panels for installation therein, said door comprising:

a rear surface adapted to close a cooking cavity of the cooking appliance and a front surface opposite the rear surface;

a removable top cap for providing access to install or remove the plurality of glass panels in or from the door;

an interlocking mechanism that promotes a correct installation of said plurality of glass panels; and a switch having a plunger that allows the cooking appliance to operate only when said plunger is in a selected position upon closure of said door and said removable top cap having a window therein through which said plunger extends when said door is closed with said removable top cap installed, wherein said plunger is depressed by a portion of an innermost glass panel accessible through said window.

2. The door of claim 1, wherein improper installation of at least one of the plurality of glass panels prevents said plunger from achieving said selected position with the removable top cap installed when the door is closed.

3. The door of claim 1, said interlocking mechanism being a bracket disposed adjacent a bottom portion of the door.

4. The door of claim 3, said bracket being translatable along a translation path extending in a direction between said front and rear surfaces, said bracket being biased either forward or rearward along said translation path by a biasing force, said bracket comprising first and second cammed portions separated from one another by a first substantially horizontal portion.

5. The door of claim 3, said bracket comprising first and second cammed portions separated from one another by a first substantially horizontal portion.

6. The door of claim 5, said bracket further comprising a second substantially horizontal portion adjacent said second cammed portion opposite said first substantially horizontal portion.

7. The door of claim 6, said bracket configured such that insertion of a first glass panel along a first insertion path within said door will cause translation of said bracket to an intermediate position along said translation path via exertion of a downward force against said first cammed portion, and such that subsequent insertion of a second glass panel along a second insertion path within said door will cause further translation of said bracket to a final position along said translation path via exertion of a downward force against said second cammed portion.

8. The door of claim 1, said interlocking mechanism being a bar extending laterally along at least a partial width of said door and disposed adjacent a bottom portion thereof.

9. The door of claim 8, said bar being translatable along a translation path extending in a direction perpendicular to the bar's length between said front and rear surfaces, said bar being biased either forward or rearward along said translation path by a biasing force.

10. The door of claim 8, said bar comprising first and second cammed surfaces separated from one another by a first substantially horizontal surface.

11. The door of claim 10, said bar further comprising a second substantially horizontal surface adjacent said second cammed surface opposite said first substantially horizontal surface.

12. The door of claim 11, said bar configured such that insertion of a first glass panel along a first insertion path within said door will cause translation of said bar to an intermediate position along said translation path via exertion of a downward force against said first cammed surface, and such that subsequent insertion of a second glass panel along a second insertion path within said door will cause further translation of said bar to a final position along said translation path via exertion of a downward force against said second cammed surface.

13. The door of claim 1, said switch being operatively coupled to an electrical circuit of the cooking appliance to communicate the plunger's position to the cooking appliance.

14. The door of claim 1, said switch being operatively coupled to a quick release locking mechanism configured to automatically lock the door in a closed position.

15. The door of claim 1, said plunger being installed in a housing of the cooking appliance such that the plunger is biased to extend toward the door.

* * * * *